US005342223A

United States Patent [19]

Geib

[11] Patent Number: 5,342,223

[45] Date of Patent: Aug. 30, 1994

[54] ELECTRICAL CONNECTOR WITH TERMINAL POSITION ASSURANCE DEVICE

[75] Inventor: Lawrence E. Geib, Bartlett, Ill.

[73] Assignee: Molex Incorporated, Lisle, Ill.

[21] Appl. No.: 151,323

[22] Filed: Nov. 12, 1993

[51] Int. Cl.[5] ..... H01R 13/436

[52] U.S. Cl. ..... 439/752; 439/595

[58] Field of Search ..... 439/595, 752

[56] References Cited

U.S. PATENT DOCUMENTS

| | | | |
|---|---|---|---|
| 4,772,229 | 9/1988 | Nix et al. | 439/733 |
| 4,846,737 | 7/1989 | Jorroch et al. | 439/752 |
| 4,867,711 | 9/1989 | Yuasa | 439/752 |
| 4,867,712 | 9/1989 | Kato et al. | 439/752 |
| 5,007,888 | 4/1991 | Goutiere | 439/189 |
| 5,116,236 | 5/1992 | Colleran et al. | 439/271 |
| 5,122,080 | 6/1992 | Hataghishi et al. | 439/595 |
| 5,256,083 | 10/1993 | Yamamoto | 439/752 |

FOREIGN PATENT DOCUMENTS

| | | |
|---|---|---|
| 0511649A2 | 4/1992 | European Pat. Off. . |
| 2248350A | 1/1992 | United Kingdom . |

*Primary Examiner*—Gary F. Paumen

*Attorney, Agent, or Firm*—A. A. Tirva

[57] ABSTRACT

An electrical connector is provided with a housing having a plurality of terminal-receiving passages extending between a forward end of the housing and a rear end thereof. A plurality of terminals are received in the passages. A plurality of primary locks are operatively associated between the housing and the terminals and are provided for locking the terminals in the passages. A terminal position assurance device is mounted on the housing for movement between first and second positions only when all of the terminals are properly positioned in their respective passages. The device is mounted on the housing for movement to a third position whereat it engages the primary locks to move the locks to an unlocking condition in response to moving the terminal position assurance device to the third position, thereby allowing removal of the terminals.

9 Claims, 3 Drawing Sheets

ELECTRICAL CONNECTOR WITH TERMINAL POSITION ASSURANCE DEVICE

FIELD OF THE INVENTION

This invention generally relates to the art of electrical connectors and, particularly, to an electrical connector which includes a terminal position assurance device.

BACKGROUND OF THE INVENTION

Terminal position assurance devices are known for use in electrical connectors to assure that all of the terminals in the connector are properly positioned within the connector housing. Basically, a terminal position assurance device is movable between a first position and a second position. The device can move to the second position only when all of the terminals are properly positioned in their respective passages. If even a single terminal is not properly positioned, the terminal position assurance device cannot move away from its first position. Such a device often is used to prevent mating of a connector with a complementary connector unless the terminal position assurance device is moved to its second or enabling position.

An area where such electrical connectors with terminal position assurance devices are extensively used is in automotive applications, where safety and security are dominant. Electrical connectors incorporated into the circuitry of an automotive vehicle are subject to extreme environmental conditions, including broad ranges of temperature, exposure to moisture, subjection to almost continuous vibration during use and frequent subjection to direct physical shock. These environmental conditions may cause a terminal to shift in the connector housing. Terminals of electrical connectors that are not properly inserted in their associated housing or that shift during such use may not provide a high quality electrical connection. In an effort to ensure that electrical connectors perform properly, automotive manufacturers often require connectors to have terminal position assurance (TPA) components.

In addition, electrical connectors used in such environments as described above must meet other requirements, such as being compact in construction, sealed against the outside environment and provided with means for locking the terminals in the connector housing to prevent the terminals from shifting or backing out of the housing.

As can be understood in relation to automotive applications, although equally problematic in other applications, repairs of electrical connectors must be anticipated, including instances when one or more terminals must be removed from the connector housing. This causes problems because, as stated above, it often is required to provide means for locking the terminals in the connector housing, and in order to remove the terminals, the housings are provided with extraneous openings, passages and the like into which separate tools are inserted to release the locking means in order to remove one or more terminals. Such provisions, in turn, cause other problems in providing adequate seals as well as maintaining compact dimensional controls on the connectors.

This invention is directed to solving the myriad of interrelated problems identified above by providing a unique system built into the terminal position assurance device, itself, for releasing the interior terminal locking means of an electrical connector and allowing selective removal of the terminals from the connector housing. Therefore, no extraneous tools are even required, much less the provision of passages, cavities and the like for insertion of such tools into the connector.

SUMMARY OF THE INVENTION

An object, therefore, of the invention is to provide a new and improved electrical connector with a terminal position assurance device which is effective to facilitate selective removal of otherwise locked terminals from the connector.

In the exemplary embodiment of the invention, an electrical connector is disclosed with a housing having a plurality of terminal-receiving passages extending between a forward mating end of the housing and a rear end thereof. A plurality of terminals are received in the passages. Primary lock means are operatively associated between the housing and the terminals for locking the terminals in the passages. A terminal position assurance device is mounted on the housing for movement between first and second positions only when all of the terminals are properly positioned in their respective passages.

The invention contemplates that the terminal position assurance device be mounted on the housing for movement to a third position. The device includes means for moving the primary lock means to an unlocking condition in response to moving the terminal position assurance device to the third position, thereby allowing removal of the terminals.

As disclosed herein, the terminal position assurance device is provided in the form of a plate-like member which is movable in a slot in the connector housing. The slot intersects the terminal receiving passages. The primary lock means include a plurality of flexible locking arms integrally molded with the housing and having lock portions engaging locking shoulders of the terminals. The lock portions project into the slot in the path of movement of the terminal position assurance device.

Still further, the terminal position assurance device includes secondary latch means for engaging and locking the terminals in the passages when the terminal position assurance device is in its second position. Specifically, each terminal includes a locking shoulder behind which the secondary latch means of the terminal position assurance device engages when in its second position and when the terminals are properly positioned in their respective passages. The flexible locking arms also engage the locking shoulders on the terminals. The terminal position assurance device includes a plurality of enlarged apertures sized and located for allowing removal of the terminals therethrough when the terminal position assurance device is in its third position.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
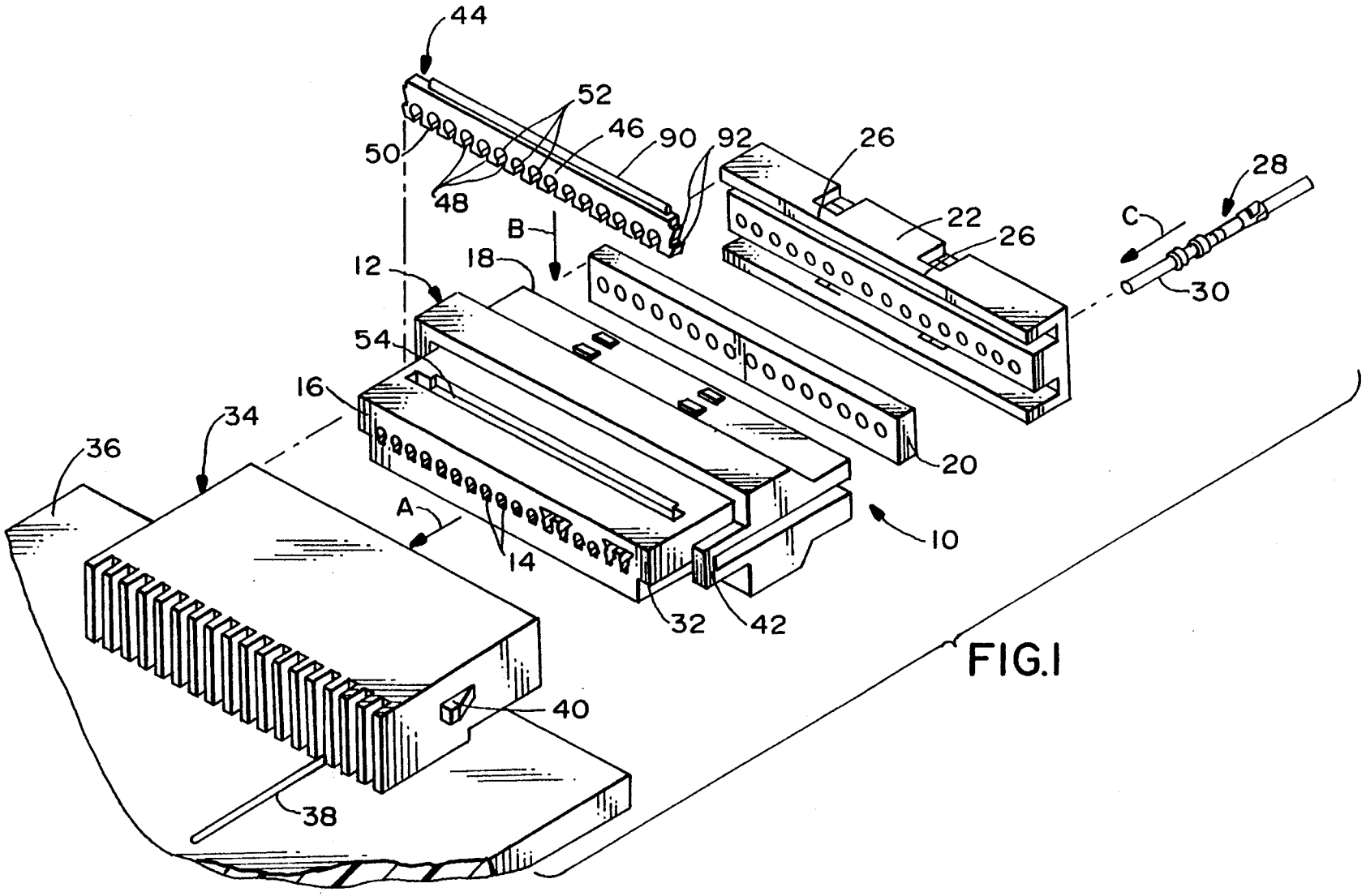
FIG. 1 is an exploded perspective view of an electrical connector embodying the concepts of the invention, in conjunction with a mating male header connector mounted on a printed circuit board.

Referring to the drawings in greater detail, and first to FIG. 1, the invention is embodied in an electrical connector, generally designated 10, which includes a housing, generally designated 12, having a plurality of terminal-receiving passages 14 extending between a forward mating end 16 of the housing and a rear end thereof. A rear seal 20 closes the rear end of the housing (as seen best in FIG. 2), and a rear seal lock 22 holds the rear seal in place. Complementary latch bosses 24 on housing 12 and resilient latch portions 26 on rear seal lock 22 hold the rear seal lock over the rear end of the housing.

Electrical connector 10 is a female connector in that housing 12 mounts a plurality of female terminals, generally designated 28, in terminal-receiving passages 14. The female terminals have at least forward female or socket ends 30 projecting forwardly in passages 14. Housing 12 defines an elongated forward plug portion 32 for insertion into a male header connector, generally designated 34, in the direction of arrow "A". Male header connector 34 is mounted on a printed circuit board 36 and includes male terminal pins (not visible in FIG. 1) connected to appropriate circuit traces on the printed circuit board, one of which is shown at 38. The male header connector includes latch bosses 40 on opposite ends thereof for interengagement with flexible latch arms 42 at opposite ends of female connector housing 12. The female connector housing is unitarily molded of dielectric material such as plastic or the like.

Lastly, still referring to FIG. 1, connector 12 includes a terminal position assurance device, generally designated 44, which is in the form of an elongated plate 46 having a plurality of slots 48 in a lower edge 50 thereof. The slots lead to respective enlarged apertures 52 in plate 46, for purposes to be described in greater detail hereinafter. Terminal position assurance device 44 is mounted on housing 12 by insertion into an elongated slot or opening 54 in the direction of arrow "B".

Figure 2:
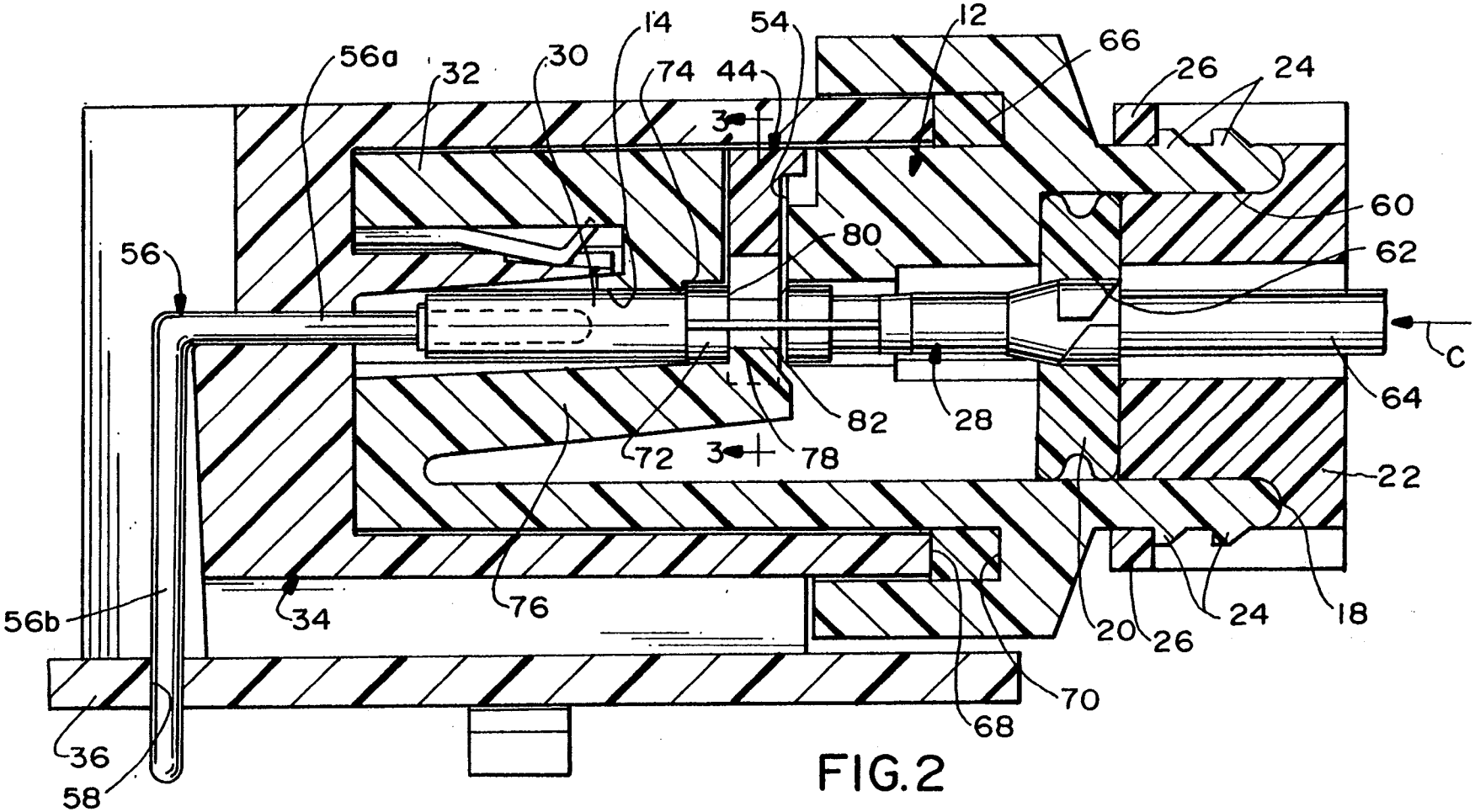
FIG. 2 is an enlarged front-to-rear vertical section through the electrical connector embodying the concepts of the invention.

Referring to FIG. 2 in conjunction with FIG. 1, one of the female terminals 28 is shown mounted in one of the respective terminal-receiving passages 14 in connector housing 12. Forward socket portion 30 of the female terminal is seen projecting into forward plug portion 32 of the housing. A generally L-shaped male terminal 56 is shown to have one leg **56*a* thereof defining a male pin for insertion into socket 30 of female terminal 28, and another leg portion 56*b* insertable through a hole 58 in printed circuit board 36. Leg portion 56*b* defines a solder tail for solder connection to a circuit trace on the board and/or in the hole. FIG. 2 also shows rear seal 20 in position within a recessed area 60 at rear end 18 of housing 12, with rear seal lock 22 holding the rear seal in position. It can be seen that the rear seal has a plurality of apertures 62 for sealingly surrounding the rear ends of female terminals 28. An electrical wire 64 also is seen terminated to female terminal 28. Lastly, a front seal 66 is shown between a mating end 68 of male header connector 34 and within a recessed area 70 of female connector housing 12**.

Generally, primary lock means are operatively associated between connector housing 12 and female terminals 28 for locking the terminals in proper position within terminal-receiving passages 14. More particularly, the terminals are inserted into connector housing 12 in the direction of arrows "C" until a flange portion 72 on each terminal abuts a shoulder 74 within its respective terminal-receiving passage. This defines the fully or properly inserted position of the respective terminal, as seen in FIG. 2. The primary lock means include a plurality of flexible, cantilevered locking arms 76 having hook portions 78 which are positionable behind shoulders 80 defined by flange portions 72 of the female terminals. In essence, the female terminals have reduced-dimensioned, necked-down portions 82 which are in registry with slot 54 which receives terminal position assurance device 44. Slot 54 for the terminal position assurance device (TPA) intersects all of the terminal-receiving passages 14, and hook portions 78 of the primary lock arms 76 project into the slot in the path of movement of the terminal position assurance device.

Figure 3:
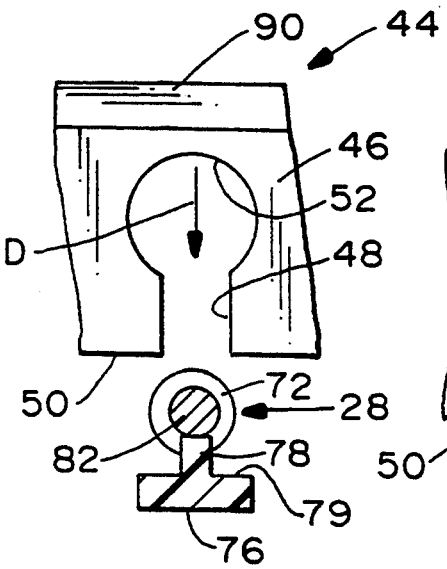
FIG. 3 is a fragmented section through one of the terminals and the surrounding area of the terminal position assurance device, with the device in a pre-load position.

The operation of TPA device 44 will now be described, with particular reference to FIGS. 3–5. More particularly, a section through the necked-down portion 82 of one of the female terminals 28 is shown in each of FIGS. 3–5 in conjunction with its associated portion of the TPA device. The TPA device is movable in the direction of arrow "D" (FIG. 3) from a first position shown in FIG. 3 to a second position shown in FIG. 4. Slots 48 in bottom edge 50 of the TPA device are wide enough for the passage therethrough of necked-down portion 28 of the female terminal, but not wide enough to accept the enlarged flange portion 72 (FIG. 2) of the female terminal. Therefore, it can be understood that the TPA device cannot move from the position of FIG. 3 to the position of FIG. 4 unless all of the terminals are fully inserted into their respective terminal-receiving passages 14, as shown by the one terminal in FIG. 2. If even a single terminal is improperly or insufficiently inserted, enlarged flange portion 72 will prevent the TPA device from moving to its second position and, thereby, indicating at least one improperly positioned terminal.

Figure 4:
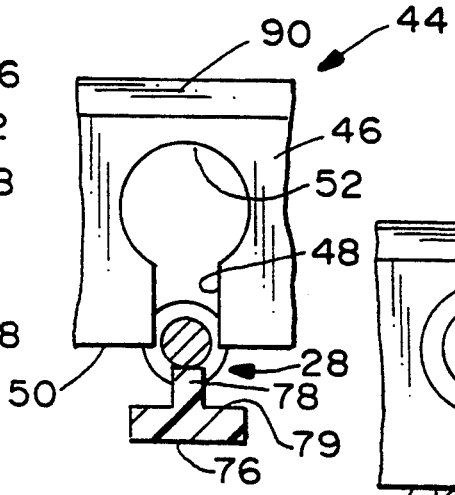
FIG. 4 is a view similar to that of FIG. 3, but with the terminal position assurance device in its second or latching position.

If all of the terminals are properly positioned, TPA device 44 can be moved to its second position as shown in FIG. 4. In this position, slots 48 in the TPA device embrace the necked-down portions 82 of terminals 28 and, with the slots being narrower than enlarged flange portions 72 of the terminals, the TPA device acts as a secondary latch means for all of the terminals. The width of the hook portions 78 is less than the diameter of the necked-down portions 82 allowing slots 48 to accept hood portions 78. It should be noted that, preferably, the width of the TPA device is such that it projects above connector housing 12 when in its first position (FIG. 3) to prevent connector 10 from mating with header connector 34. However, in the second position of the TPA device as shown in FIG. 4, preferably the TPA device is moved completely within the bounds of connector housing 12, in slot 54, to allow mating of the connectors.

Figure 5:
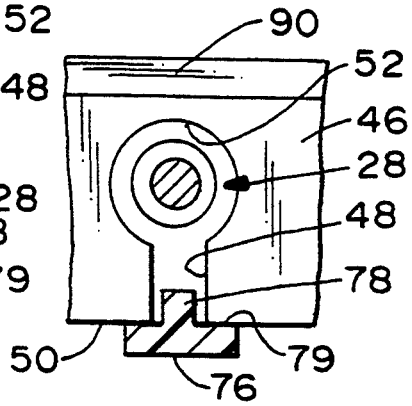
FIG. 5 is a view similar to that of FIGS. 3 and 4, but with the terminal position assurance device in its third position allowing removal of the terminals.

The invention contemplates that terminal position assurance device 44 be movable to a third position as shown in FIG. 5. In this position, slots 48 in the TPA device are moved below the necked-down portions 82 of the female terminals and out of the latching condition therewith. In the third position (FIG. 5), enlarged apertures 52 now are in registry with the terminals. These apertures are of a size larger than enlarged flange portions 72 of the terminals, whereby the terminals can be selectively removed from the connector housing opposite arrow "C" (FIG. 2). When the TPA device is moved to its third position as shown in FIG. 5, bottom edge 50 thereof is effective to engage wing portions 79 of hook portions 78 of lock arms 76 and move the lock arms downwardly in the direction of arrow "E" (FIG. 5) to effectively unlock the primary lock means of the connector to allow the aforesaid removal of the terminals.

It should be understood that the connector is designed such that cantilevered lock arms 76 act as a composite spring means for biasing TPA device 44 from its third position (FIG. 5) to its second position (FIG. 4). Therefore, when a removed or repaired/replaced terminal is inserted back into the connector housing, the TPA device is pushed against the biasing forces of the lock arms and, when released, the lock arms will bias the TPA device back to its second, latching position. Should the TPA device bind for some reason, the TPA device has a narrow rib 90 (FIG. 1) along the top edge thereof and which is graspable by an appropriate pincher's tool to pull the TPA device from its third position back to its second, latching position.

Figure 6:
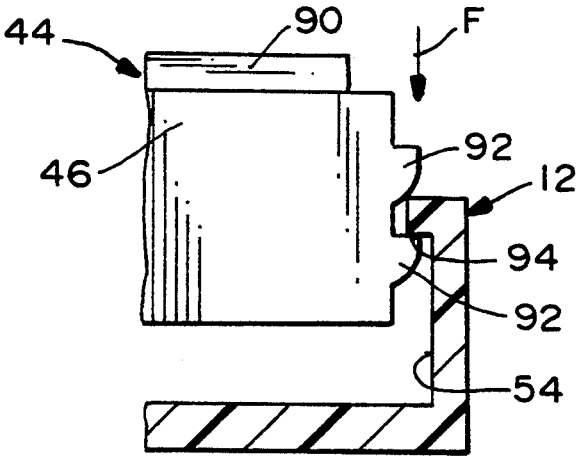
FIG. 6 is a fragmented section through the cooperative detent means between the terminal position assurance device and the connector housing to define discrete first and second positions for the device.

Lastly, FIG. 6 shows a pair of position-defining detents 92 projecting outwardly from each opposite end of TPA device 44. The detents also can be seen in FIG. 1. The detents are releasably engagable behind a detent should 94 within slot 54 of housing 12 at opposite ends of the slot, and define two discrete positions for the TPA device as shown in FIGS. 3 and 4. The position of the TPA device 44 shown in FIG. 6 corresponds to the first position shown in FIG. 3, with the lower detent 92 snapped behind detent shoulder 94. When the TPA device is pushed downwardly in the direction of arrow "F" (FIG. 6), the upper detent 92 will snap behind detent shoulder 94 to releasably hold the TPA device in its second position corresponding to FIG. 4.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. In an electrical connector which includes housing means having a plurality of terminal-receiving passages extending between a forward mating end of the housing means and a rear end thereof, a plurality of terminals received in the passages, primary lock means operatively associated between the housing means and the terminals for locking the terminals in the passages, and a terminal position assurance device mounted on the housing means for movement between first and second positions only when all of the terminals are properly positioned in their respective passages, wherein the improvement comprises:

said terminal position assurance device being mounted on the housing means for movement to a third position and including means for moving said primary lock means to an unlocking condition in response to moving the terminal position assurance device to the third position thereby allowing removal of the terminals, and said terminal position assurance device includes secondary latch means for engaging and locking the terminals in the passages when the terminal position assurance device is in its second position.

2. In an electrical connector as set forth in claim 1, wherein said terminal position assurance device is movable in opening means in the housing means, the opening means intersecting the terminal-receiving passages, and the primary lock means projecting into the opening means in the path of movement of the terminal position assurance device.

3. In an electrical connector as set forth in claim 1, wherein each of said terminals includes a locking shoulder behind which the secondary latch means of the terminal position assurance device engages when in its second position and when the terminals are properly positioned in their respective passages.

4. In an electrical connector as set forth in claim 3, wherein said primary lock means include flexible locking arms on the housing means and having lock portions for lockingly engaging the locking shoulders of the terminals.

5. In an electrical connector as set forth in claim 3, wherein said terminal position assurance device includes a plurality of enlarged apertures sized and located for allowing removal of the terminals therethrough when the terminal position assurance device is in its third position.

6. An electrical connector, comprising:

a housing having a plurality of terminal-receiving passages extending between a forward mating end of the housing and a rear end thereof, the housing having a slot intersecting the terminal-receiving passages;

a plurality of terminals received in the passages, the terminals each including a locking shoulder;

primary lock means operatively associated between the housing and the terminals for locking the terminals in the passages, the primary lock means projecting into the slot in the housing;

a terminal position assurance device movably mounted in the slot in the housing for movement between first, second and third positions, the device being movable from the first to the second position only when all of the terminals are properly positioned in their respective passages, the device including secondary latch means for engagement behind the locking shoulders of the terminals when the device is in its second position and when the terminals are properly positioned in their respective passages; and complementary interengaging means between the terminal position assurance device and the primary lock means for moving the primary lock means to an unlocking condition in response to moving the terminal position assurance device to the third position thereby allowing removal of the terminals.

7. The electrical connector of claim 6 wherein said primary lock means include flexible locking arms on the housing and having lock portions for lockingly engaging the locking shoulders of the terminals, the lock portions projecting into the slot in the housing in the path of movement of the terminal position assurance device.

8. The electrical connector of claim 6 wherein said terminal position assurance device includes a plurality of enlarged apertures sized and located for allowing removal of the terminals therethrough when the terminal position assurance device is in its third position.

9. The electrical connector of claim 5 wherein said terminals have reduced-dimensioned necked-down portions, and said terminal position assurance device includes a plurality of slots extending between an edge thereof to said enlarged apertures, the slots being of a width slightly larger than the necked-down portions of the terminals and being in registry therewith when the device is in its second position to define said secondary latch means.

* * * * *